US011244641B2

(12) United States Patent
Tseng et al.

(10) Patent No.: US 11,244,641 B2
(45) Date of Patent: Feb. 8, 2022

(54) METHOD, DEVICE AND DISPLAY DRIVER HAVING A FILTERED COMMAND SIGNAL

(71) Applicant: NOVATEK Microelectronics Corp., Hsinchu (TW)

(72) Inventors: Wei-Sheng Tseng, Hsinchu County (TW); Wen-Sheng Chen, Taoyuan (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 17/006,912

(22) Filed: Aug. 31, 2020

(65) Prior Publication Data

US 2021/0118380 A1 Apr. 22, 2021

Related U.S. Application Data

(60) Provisional application No. 62/916,240, filed on Oct. 17, 2019.

(51) Int. Cl.
*G09G 3/36* (2006.01)

(52) U.S. Cl.
CPC ... *G09G 3/3611* (2013.01); *G09G 2310/0286* (2013.01); *G09G 2310/0294* (2013.01); *G09G 2310/0297* (2013.01)

(58) Field of Classification Search
CPC ..... G09G 3/3611
USPC ..... 345/690
See application file for complete search history.

(56) References Cited

U.S. PATENT DOCUMENTS

2001/0022573 A1* 9/2001 Sasaki ..... G09G 3/3688 345/100
2010/0259565 A1* 10/2010 Nakagawa ..... G09G 3/20 345/690
2011/0148851 A1* 6/2011 Sugiyama ..... G09G 5/006 345/213

* cited by examiner

*Primary Examiner* — Long D Pham
(74) *Attorney, Agent, or Firm* — CKC & Partners Co., LLC

(57) ABSTRACT

A device is applicable to a display driver, including a sampling circuit and a logic circuit. The sampling circuit is configured to sample a command signal by recording a plurality of command values of the command signal at different times. The plurality of command values corresponds to at least one data line of a pixel circuit. The logic circuit is electrically coupled to the sampling circuit, and is configured to receive the plurality of command values. The logic circuit is further configured to generate a filtered command signal according to the plurality of command values, and is configured to provide the filtered command signal to drive the pixel circuit.

23 Claims, 6 Drawing Sheets

200

300

400

500

METHOD, DEVICE AND DISPLAY DRIVER HAVING A FILTERED COMMAND SIGNAL

CROSS-REFERENCE TO RELATED APPLICATION

This application claims priority to U.S. Provisional Application Ser. No. 62/916,240, filed Oct. 17, 2019, which is herein incorporated by reference in its entirety.

BACKGROUND

Technical Field

The present disclosure relates to a method, device and display driver, more particularly, to drive a display panel according to a command signal.

Description of Related Art

With the development of display technology, the display device is widely used in daily lives of people and as an increasingly important role. For example, the display device can be used in various electronic devices such as televisions, computers, mobile phones to present various information.

In general, a display driver of the display device will provide a command signal, which includes clock signal and data signal, to the display panel according to an image signal, so that the display panel displays the images with desired brightness or color. This driving process will directly affect the display quality of the display panel.

SUMMARY

One aspect of the present disclosure is a method for driving a display panel, comprising: receiving a command signal by a display driver; recording a plurality of command values of the command signal at different times, wherein the plurality of command values corresponds to at least one data line of a pixel circuit; determining a most-probably correct command value according to the plurality of command values, and generating a filtered command signal indicating the determined most-probably correct command value; and driving the pixel circuit according to the filtered command signal.

Another aspect of the present disclosure is a device applicable to a display driver, including a sampling circuit and a logic circuit. The sampling circuit is configured to sample a command signal by recording a plurality of command values of the command signal at different times. The plurality of command values corresponds to at least one data line of a pixel circuit. The logic circuit is electrically coupled to the sampling circuit, and is configured to receive the plurality of command values. The logic circuit is further configured to generate a filtered command signal according to the plurality of command values, and is configured to provide the filtered command signal to drive the pixel circuit.

Another aspect of the present disclosure is a display driver, including a converter circuit, a signal filtering device and a driving circuit. The converter circuit is configured to receive at least one original signal, and is configured to acquire a command signal from the at least one original signal. The signal filtering device is electrically coupled to the converter circuit. The signal filtering device is configured to record a plurality of command values of the command signal at different times, the plurality of command values corresponds to at least one data line of a pixel circuit. The signal filtering device is further configured to determine a most-probably correct command value according to the plurality of command values to generate a filtered command signal indicating the determined most-probably correct command value. The driving circuit is electrically coupled to the signal filtering device to receive the filtered command signal. The driving circuit is configured to drive the pixel circuit according to the filtered command signal.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

In some embodiments, a command received by a display driver can be sampled at different times to obtain a plurality of command values. Various procedures can be performed to determine a final command value used for controlling the display driver in driving a display panel. In some embodiments, a "most-probably correct command value" may be determined to be a most representative command value among the plurality of command values, such as a most repetitive command value or a majority of the command values, or a most repetitive and consecutive command value among the command values. Resistance to signal interferences can be therefore achieved, avoiding abnormal displayed images.

Figure 1:
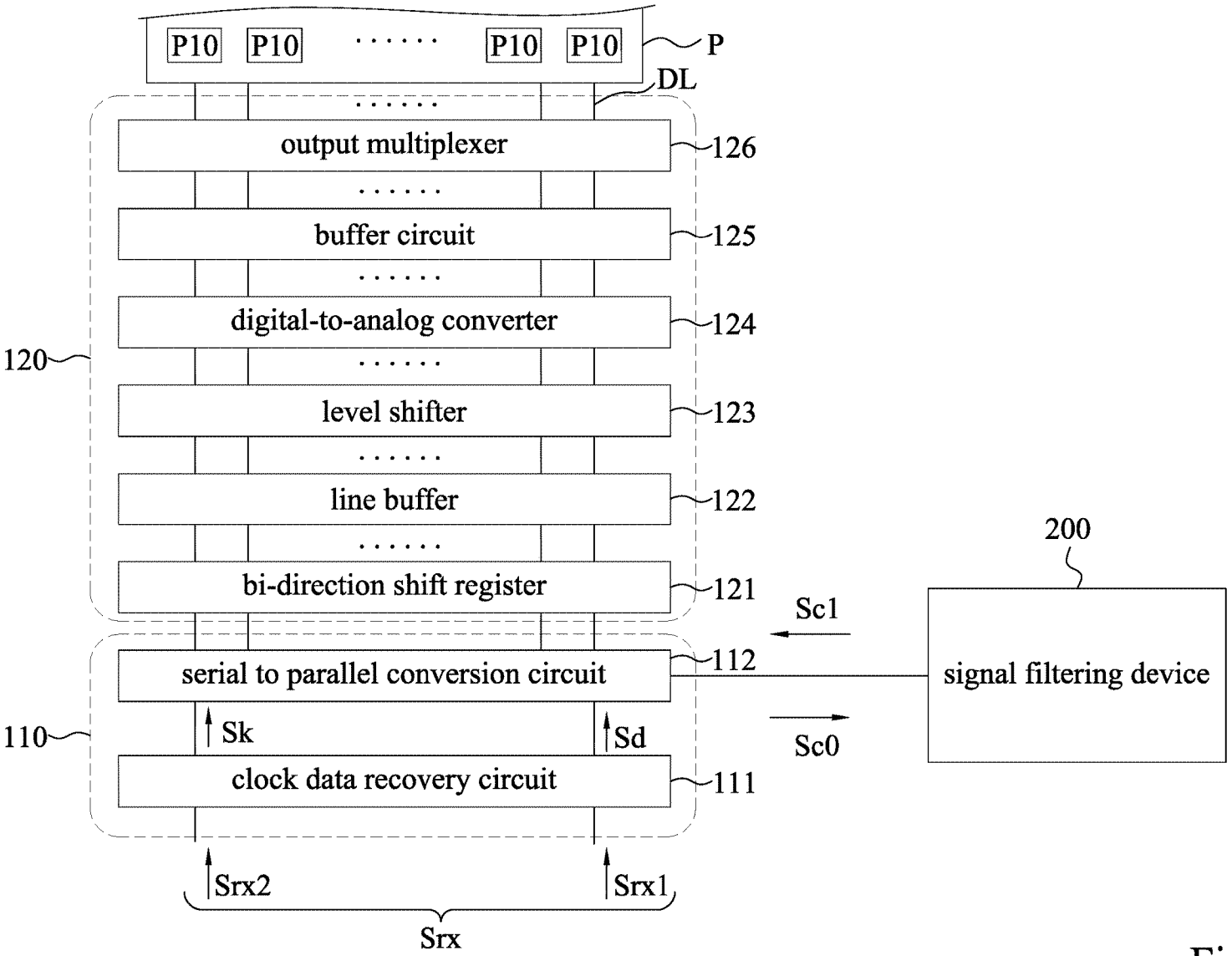
FIG. 1 is a schematic diagram of a display driver in some embodiments of the present disclosure.

Referring to FIG. 1, embodiments of the present disclosure relate to a display driver 100 configured to drive a display panel P. The display panel P includes at least one pixel circuit P10. In some embodiments, the display panel P may be implemented as a liquid-crystal display (LCD) panel, but the present disclosure is not limited to this.

The display driver 100 can include a convert circuit 110, a signal filtering device 200 and a driving circuit 120. The display driver 100 is configured to receive at least one original signal Srx, and then acquires a command signal Sc0 from the original signal Srx. After filtering an error value in the control command Sc0, the display driver 100 drives the pixel circuit P10 of the display panel P according to the filtered command signal Sc1.

The convert circuit 110 acquires a command signal Sc0 from the original signal Srx. In some embodiments, the original signal Srx is configured to drive the pixel circuit P10 to display an expected pixel brightness. Multiple command values in the control command Sc0 correspond to at least one data line DL of the pixel circuit P10. Alternatively, the command value in the control command Sc0 can be any kind of control command used for driving the pixel circuit P10 through the corresponding data line DL. In some embodiments, the logic circuit 220 sets at least one of a bandwidth, a current value and a driving frequency of the pixel circuit P10 according to the filtered command signal Sc1.

Figure 2A:
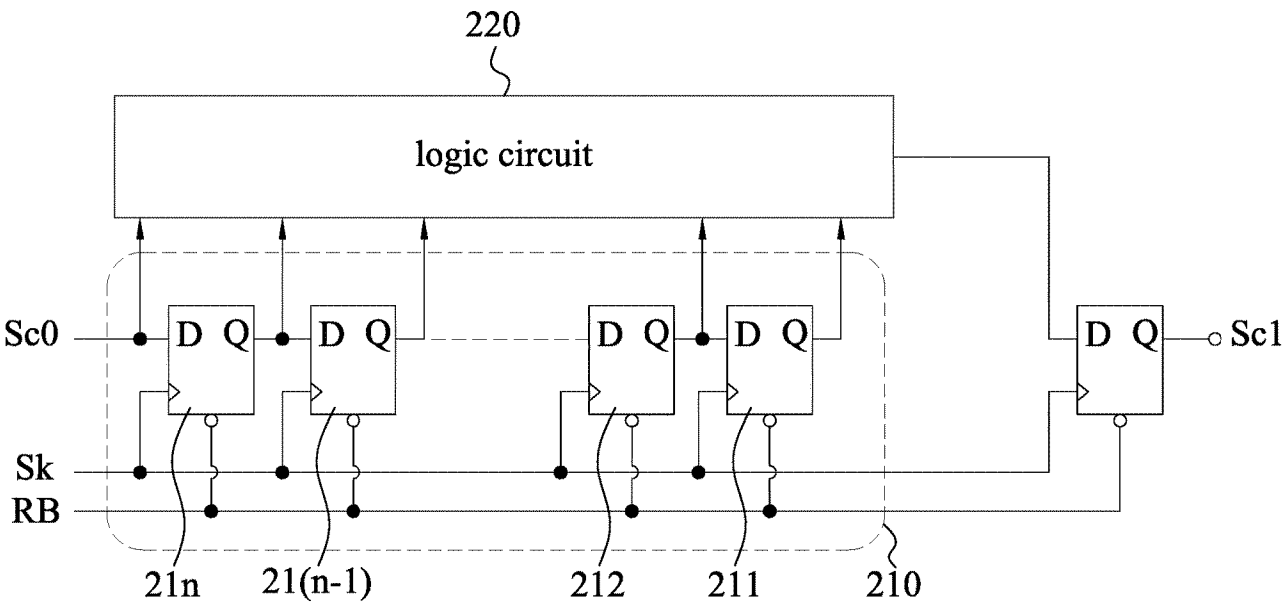
FIG. 2A is a schematic diagram of a signal filtering device in some embodiments of the present disclosure.

Referring to FIG. 2A the signal filtering device 200 is applicable to the display driver 100, and includes a sampling circuit 210 and a logic circuit 220. The sampling circuit 210 is configured to sample the command signal Sc0 by recording the multiple command values of the command signal Sc0 at different times. For example, the sampling circuit 210 sequentially receives multiple command values such as "0, 0, 0, 1, 0, 0".

The logic circuit 220 is electrically coupled to the sampling circuit 210, and configured to receive the command values Sc0. The logic circuit 220 is further configured to generate a filtered command signal Sc1 according to the command values, and is configured to provide the filtered command signal Sc1 to drive the pixel circuit P10. In some embodiments, the logic circuit 220 is configured to determine a most-probably correct command value according to the command values. In some embodiments, the above "most-probably correct command value" may be determined to be a most representative command value among the plurality of command values, such as a most repetitive command value among multiple command values, or a most repetitive and consecutive command value among multiple command values.

Figure 2B:
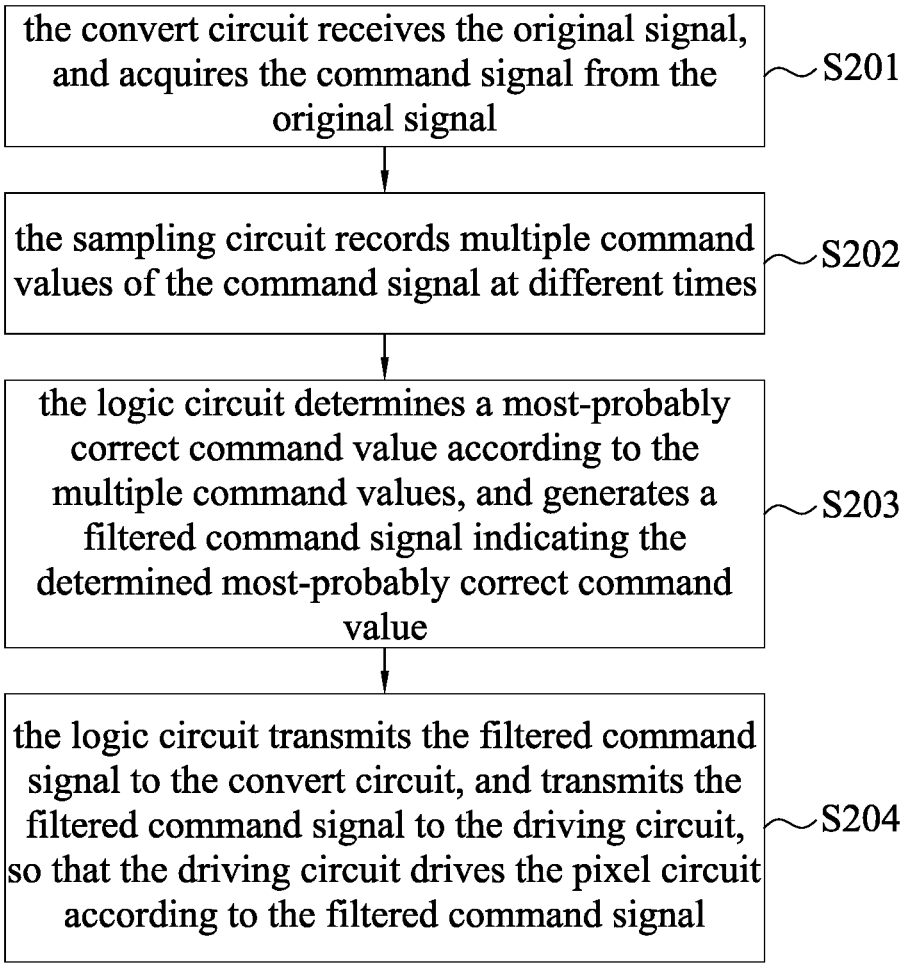
FIG. 2B is a flowchart illustrating a method in some embodiments of the present disclosure.

FIG. 2B is a flowchart illustrating a method applied to the display driver 100 according to some embodiments of the present disclosure. Referring to FIG. 1, FIG. 2A and FIG. 2B, in step S201, the convert circuit 110 receives the original signal Srx, and acquires the command signal Sc0 from the original signal Srx. In some embodiments, the convert circuit 110 receives a first original signal Srx1, and acquires the data signal Sd from the first original signal Srx1. The convert circuit 110 receives a second original signal Srx2, and acquires the clock signal Sk (known as the signal "CLK") from the second original signal Srx2. The command signal Sc0 (known as the signal "CMD" in the data signal Sd) can be in the data signal Sd. The convert circuit 110 can transmit the command signal Sc0 to the sampling circuit 210 of the signal filtering device 200.

In step S202, the sampling circuit 210 records multiple command values of the command signal at different times. Command values correspond to the data line DL of a pixel circuit P10. In some embodiments, the command signal Sc0 in the data signal Sd includes multiple command values sent repeatedly. Alternatively stated, multiple command values of the same command signal Sc0 should be the same, but some of the command values may be wrong because of interference or noise. When the sampling circuit 210 receives multiple command values of the command signal Sc0 at different times, the sampling circuit 210 may sample or register command values, and then transmits the sampled or registered command values to the logic circuit 220 for analysis.

In step S203, the logic circuit 220 determines a most-probably correct command value according to the multiple command values, and generates a filtered command signal Sc1 indicating the determined most-probably correct command value (i.e., the correct value). As mentioned above, the above "most-probably correct command value" may be determined to be a most representative command value among the plurality of command values, such as a most repetitive command value among multiple command values, or a most repetitive and consecutive command value among multiple command values. For example, multiple command values of the command signal are "0, 0, 0, 1, 0", in which "0" appears 4 times, and "1" appears once. Accordingly, "0" is a most repetitive command value among multiple command values, and is also a majority of the multiple command values. On the other hand, the multiple command values include 3 consecutive command values that are "0", so "0" is a most repetitive and consecutive command value.

In step S204, the logic circuit 220 transmits a filtered command signal Sc1 to the convert circuit 110. The convert circuit 110 transmits the received filtered command signal Sc1 to the driving circuit 120, so that the driving circuit 120 drives the pixel circuit P10 according to the filtered command signal Sc1. In some embodiments, the logic circuit 220 sets at least one of a bandwidth, a current value and a driving frequency of the pixel circuit P10 according to the filtered command signal Sc1.

Referring to FIG. 2A, in one embodiment, the sampling circuit 210 comprises multiple registers 211-21*n* electrically coupled in cascade. A present register of the multiple registers 211-21*n* is configured to receive the command signal Sc0 according to the clock signal Sk and the signal RB (e.g., the signal used to set the initial value of the multiple registers 211-21*n*), and configured to transmit the command signal Sc0 to a next register of the multiple registers 211-21*n*. In some embodiments, each of the multiple registers 211-21*n* comprises a D-type Flip Flop.

For example, multiple command values of the command signal are "0, 0, 0, 1, 0". The register 21*n* receives and transmits the first "0" to the register 21($n$−1). The register 21($n$−1) receives and transmits the first "0" to the next register. When the registers 211-21*n* receive all of the command values of the command signal, the register 211 is configured to record the first command value "0", and the register 21*n* is configured to record the last command value "0". The logic circuit 220 records all of the command values of the command signal in sequence, and determines the most-probably correct command value.

Figure 3:
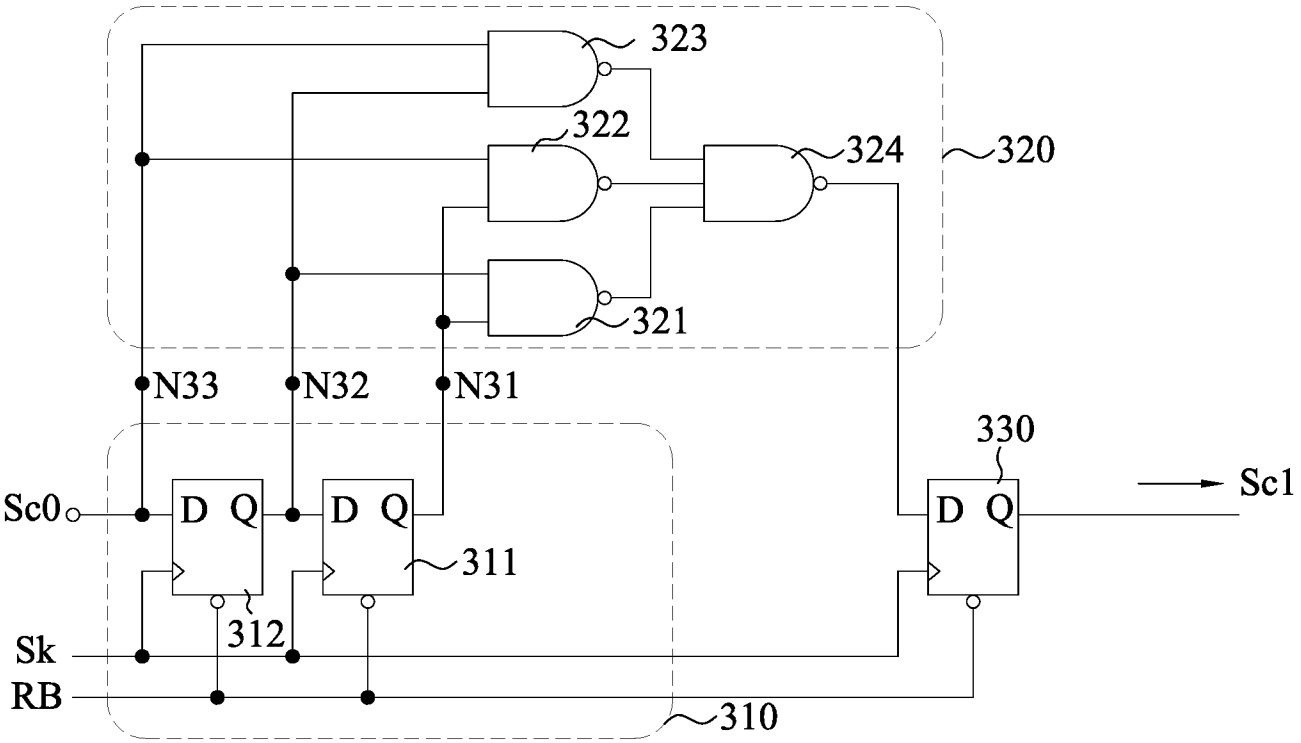
FIG. 3 is a schematic diagram of a signal filtering device in some embodiments of the present disclosure.

FIG. 3 is a circuit diagram of a signal filtering device 300 according to some embodiments of the present disclosure. Referring to FIG. 3, the signal filtering device 300 includes a sampling circuit 310 and a logic circuit 320. The sampling circuit 310 is electrically coupled to the logic circuit 320 through multiple terminals N31-N33. The logic circuit 320 is configured to record multiple command values at multiple time points by multiple terminals, respectively. Alternatively stated, recording a first command value of the multiple command values at a first time point by a first terminal N31, recording a second command value of the multiple command values at a second time point by a second terminal N32, and recording a third command value of the multiple command values at a third time point N33 by a third terminal, so that the logic circuit 320 may set a majority of the multiple command values to a most-probably command value of the command signal Sc1.

In some embodiments, the sampling circuit 310 includes multiple registers (e.g., registers 311-312) electrically coupled in cascade. Each of the multiple registers 311-312 is configured to receive the command signal Sc0 and configured to transmit the command signal Sc0 to a next register of the multiple registers 311-312. The operation of the sampling circuit 310 is the same as the operation of the sampling circuit 210 in FIG. 2A, so it is not be repeated here.

In some embodiments, the logic circuit 320 includes multiple logic gates electrically coupled to a subset of the terminals to receive a subset of the command values, respectively. Specifically, the logic circuit 320 includes a first NAND gate 321, a second NAND gate 322 and a third NAND gate 323. The first NAND gate 321 is electrically coupled to the first terminal N31 to receive the first command value, and electrically coupled to the second terminal N32 to receive the second command value. The second NAND gate 322 is electrically coupled to the first terminal N31 to receive the first command value, and electrically coupled to the third terminal N33 to receive the third command value. The third NAND gate 323 is electrically coupled to the second terminal N32 to receive the second command value, and electrically coupled to the third terminal N33 to receive the third command value.

In some embodiments, the logic circuit 320 further includes a fourth NAND gate 324. The fourth NAND gate 324 is electrically coupled to outputs terminals of the first NAND gate 321, the second NAND gate 322 and the third NAND gate 323. Accordingly, the fourth NAND gate 324 may set a majority of the multiple command values to a most-probably command value of the filtered command signal. Alternatively stated, the most representative command value among the multiple command values is defined as a most repetitive command value among the multiple command values, and "the most repetitive command value" is the command value of a majority of the multiple command values.

For example, multiple command values of the command signal are "0, 0, 1". The first terminal N31 receives the first command value "0", the second terminal N32 receives the second command value "0", the third terminal N33 receives the third command value "1". At this time, all of the output terminals of the NAND gate 321-323 output "1", so the output terminal of the fourth NAND gate 324 may output "0". Alternatively stated, "0" is the majority of the multiple command values. In some embodiments, the logic circuit 320 transmits the majority of the multiple command values to an output register 330. The truth table of the logic circuit 320 is as follows:

| N33 | N32 | N31 | Sc1 |
|---|---|---|---|
| 0 | 0 | 0 | 0 |
| 1 | 0 | 0 | 0 |
| 0 | 1 | 0 | 0 |
| 1 | 1 | 0 | 1 |
| 0 | 0 | 1 | 0 |

-continued

| N33 | N32 | N31 | Sc1 |
|---|---|---|---|
| 1 | 0 | 1 | 1 |
| 0 | 1 | 1 | 1 |
| 1 | 1 | 1 | 1 |

In the above embodiment, for example in FIG. 3, the logic circuit 320 sets a majority of the multiple command values to the most-probably command value. The present disclosure is not limited to the above embodiments.

Figure 4:
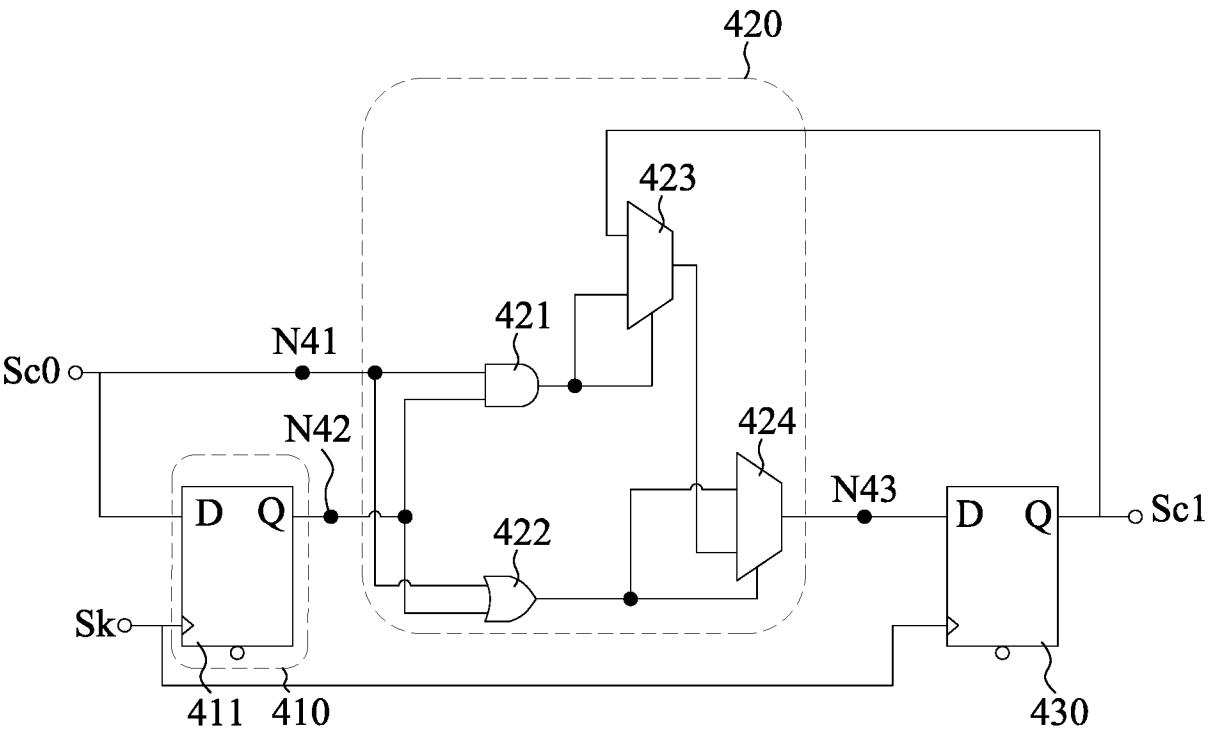
FIG. 4 is a schematic diagram of a signal filtering device in some embodiments of the present disclosure.

FIG. 4 is a circuit diagram of a signal filtering device 400 according to some embodiments of the present disclosure. The signal filtering device 400 corresponds to the signal filtering device 200 as illustrated in FIG. 1. Referring to FIG. 4, the signal filtering device 400 includes a sampling circuit 410, a logic circuit 420 and an output register 430. The sampling circuit 410 comprises a register 411 configured to receive the command values of the command signal Sc0. The register 411 may be implemented by a D type Flip-Flop. The first input terminal N41 of the logic circuit 420 is configured to receive the command values of the command signal Sc0. The second input terminal N42 of the logic circuit 420 is electrically coupled to the output terminal of the sampling circuit 410.

The logic circuit 420 may determine whether the multiple command values of the command signal Sc0 comprise N consecutive command values that are the same, and N is a positive predetermined integer greater than or equal to 2. The logic circuit 420 sets the N consecutive command values of the command signal Sc0 to the most-probably command value of the filtered command signal Sc1.

In some embodiments, the logic circuit 420 includes multiple logic gates and multiple multiplexers. The logic gates are configured to perform a logic operation of a present command value and a next command value. The multiplexers are electrically coupled to multiple output terminals of the logic gates and an output terminal of the logic circuit 420. Specifically, the logic circuit 420 includes an AND gate 421, an OR gate 422, a first multiplexer 423 and a second multiplexer 424. The AND gate 421 is electrically coupled to the output terminal of the sampling circuit 410, and is configured to perform an AND operation of a present command value and a next command value of the multiple command values. The OR gate 422 is electrically coupled to the output terminal of the sampling circuit 410, and configured to perform an OR operation of the present command value and the next command value of the multiple command values.

For example, command values of the command signal Sc0 are "0, 1, 0 . . . ", the first command value "0" is stored by the register 411 first, then when the second command value "1" is input to the signal filtering device 400, the AND gate 421 receives the second command value "1" through the input terminal N41, and receives the first command value "0 output by the register 411. Similarly, the OR gate 422 receives the second command value "1" through the input terminal N41, and receives the first command value "0 output by the register 411.

The two input terminals of the first multiplexer 423 are electrically coupled to the output terminal of the AND gate 421 and the output terminal N43 of the logic circuit 420. The output register 430 is electrically coupled between the input terminal of the first multiplexer 423 and the output terminal of the second multiplexer 424 to from a feedback path. Alternatively stated, one of the input terminals of the first multiplexer 423 receives the feedback signal by the output of the logic circuit 420. The control terminal of the first multiplexer 423 is electrically coupled to the output terminal of the AND gate 421.

The two input terminals of the second multiplexer 424 is electrically coupled to the output terminal of the OR gate 422 and the output terminal of the first multiplexer 423. The output terminal of the second multiplexer 424 electrically coupled to the output terminal N43 of the logic circuit 420. The control terminal of the second multiplexer 424 is electrically coupled to the output terminal of the OR gate 422. The logic circuit 420 is configured to record the number of maximum consecutive occurrences of the current command value of the command signal. The truth table of the logic circuit 420 is as follows, wherein Sc1 [n+1] represents the current output value of the filter command signal Sc1. Sc1 [n] represents the previous output value of the filter command signal Sc1:

| N41 | N42 | Sc1[n + 1] |
|---|---|---|
| 0 | 0 | 0 |
| 1 | 0 | Sc1[n] |
| 0 | 1 | Sc1[n] |
| 1 | 1 | 1 |

In some other embodiments, the logic circuit may comprise a counter configured to count and generate the N consecutive command values.

Accordingly, the logic circuit can determine a most repetitive and consecutive command value among multiple command values. For example, the logic circuit 220 of the FIG. 2A or the logic circuit 420 of the FIG. 4 may be implemented by a counter, and the truth table of the logic circuit is the same as the above table.

"N" in the above N consecutive command values may be a threshold value that can be adjusted (e.g., 2, 3, 4 . . . ). The structure of the logic circuit can be recorded using a counter circuit without using N-level D Flip-Flop, for example, in cases where N is much greater than 2.

Figure 5:
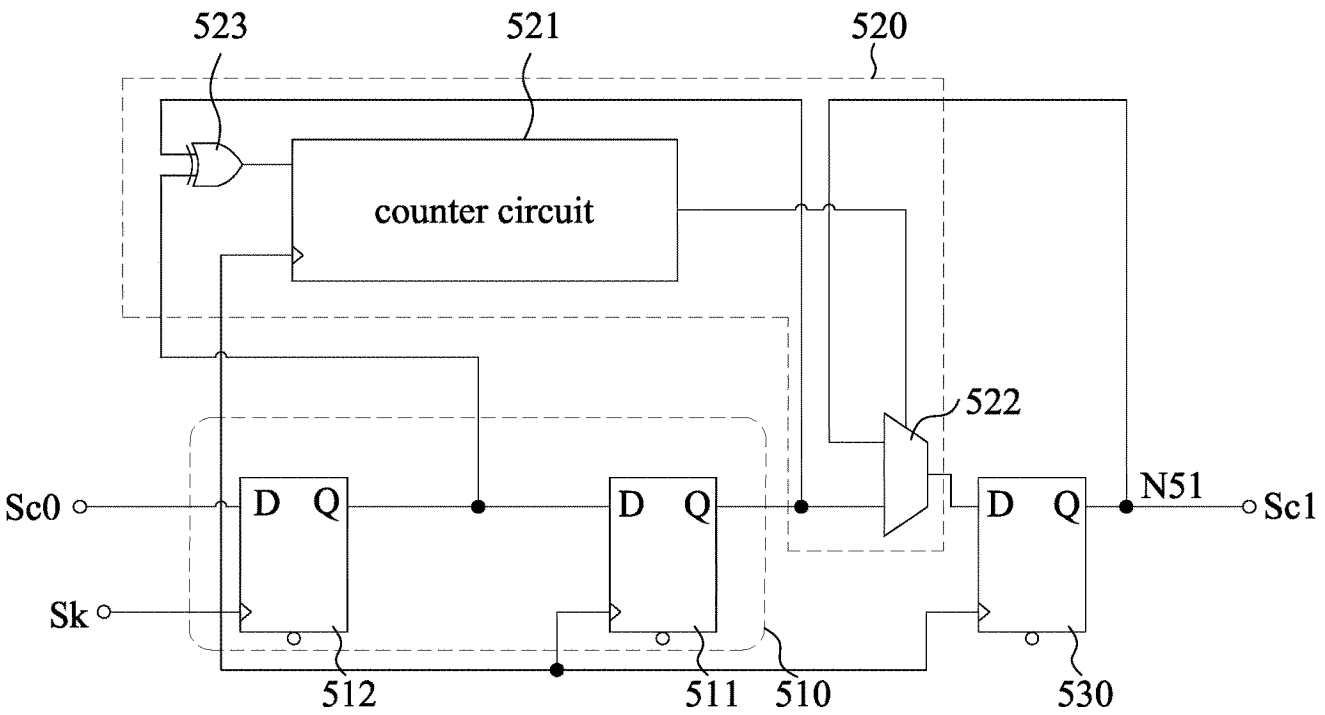
FIG. 5 is a schematic diagram of a signal filtering device in some embodiments of the present disclosure.

FIG. 5 is a circuit diagram of a signal filtering device 400 according to some embodiments of the present disclosure. The signal filtering device 500 corresponds to the signal filtering device 200 as illustrated in FIG. 1. In some other embodiments, the signal filtering device 500 includes a sampling circuit 510, a logic circuit 520 and an output register 530. The sampling circuit 510 comprises multiple registers electrically coupled in cascade (e.g., a first register 511 and a second register 512). The logic circuit 520 includes a counter circuit 521 and a multiplexer 522. The counter circuit 521 is configured to record the multiple command values of the command signal, and configured to output a counter signal.

The multiplexer 522 is configured to receive the multiple command values through the sampling circuit 510, and receive a feedback signal from an output terminal N51 of the signal filtering device 500. The multiplexer 522 is configured to selectively output the received command signal or the feedback signal according to the counter signal. The output register 530 is electrically coupled to an output terminal of the logic circuit 520.

In some embodiments, the logic circuit 520 further comprises a logic gate such as a XOR gate 523. The XOR gate 523 is electrically coupled to an output terminal of the first register 511 and an output terminal of the second register 512. The output terminal of the XOR gate 523 is electrically coupled to an input terminal of the counter circuit 521. In one embodiment, the sampling circuit 510 sequentially receives command values of the command signal Sc0 by the first register 511 and the second register 512. When the two command values of the command signal Sc0 is different, the signals received at the input terminals of the XOR gate 523 are different, causing the XOR gate 523 to output an enable signal to the counter circuit 521. Next, the counter circuit 521 can recount. The above "N" is related to the number of bits in the counter circuit 521. Accordingly, a most repetitive and consecutive command value among multiple command values can be output.

Referring back to the FIG. 1, which also shown a detailed structure of the display driver 100 according to some embodiments. The detailed structure is used for purpose of explanation and the disclosure is not limited to the detailed structure. The converter circuit 110 may include a clock data recovery circuit 111 and a serial to parallel conversion circuit 112. The clock data recovery circuit 111 receives the original signal Srx1, Srx2, and acquires the clock signal Sk and the data signal Sd from the first original signal Srx1 and the second original signal Srx2. Then, the Clock Data Recovery circuit 111 can transmit the clock signal Sk and the data signal Sd to the serial to parallel conversion circuit 112.

The serial to parallel conversion circuit 112 is configured to convert the data signal Sd from series to parallel, and is configured to transmit the command signal Sc0 of the data signal Sd to the signal filtering device 200. In some embodiments, the serial to parallel conversion circuit 112 transmits the converted data signal Sd to the signal filtering device 200.

The signal filtering device 200 records the multiple sets of command values of the command signal at different times. Each set of command values corresponds to a data line of a pixel circuit P10. The signal filtering device 200 further determines a most-probably correct command value according to the set of command values to generate a filtered command signal Sc1 indicating the determined most-probably correct command value.

The serial to parallel conversion circuit 112 may regenerate the data signal Sd according to the filterer command signal Sc1, and may transmit the data signal Sd and the clock signal Sk to the driving circuit 120.

The driving circuit 120 is electrically coupled to the signal filtering device 200 to receive the filtered command signal Sc1, and the driving circuit 120 may include a bi-direction shift register 121, a line buffer 122, a level shifter 123, a digital-to-analog converter 124, a buffer circuit 125 and an output multiplexer 126. The bi-direction shift register 121 is configured to receive the data signal Sd and the clock signal Sk.

The digital-to-analog converter 124 may receives the data signal Sd and which have been processed by the line buffer 122 and the level shifter 123, and converts data signal Sd from a digital format to an analog format which is then used to drive the display panel by the buffer circuit 125. The output multiplexer 126 may be implemented to transmit the analog data signal Sd to different pixel circuits P10 through different data lines DL.

As mentioned above, the display driver 100 may set at least one of a bandwidth, a current value and a driving frequency of the pixel circuit P10 according to the filtered command signal Sc1. In some embodiments, the driving circuit 120 sets current or value of the data signal Sd by the bi-direction shift register 121, the level shifter 123 or the digital-to-analog converter 124 according to the filtered command signal Sc1.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A method for driving a display panel, comprising:

receiving a command signal by a display driver;

recording a plurality of command values of the command signal at different times, wherein the plurality of command values corresponds to at least one data line of a pixel circuit;

determining a most-probably correct command value according to the plurality of command values, and generating a filtered command signal indicating the determined most-probably correct command value, wherein the most-probably correct command value is determined to be a most representative command value among the plurality of command values; and driving the pixel circuit according to the filtered command signal.

2. The method of claim 1, wherein the most representative command value among the plurality of command values is defined as a most repetitive command value among the plurality of command values.

3. The method of claim 2, wherein the most repetitive command value is the command value of a majority of the plurality of command values.

4. The method of claim 1, wherein the most representative command value among the plurality of command values is defined as a most repetitive and consecutive command value among the plurality of command values.

5. The method of claim 4, wherein the most repetitive and consecutive command value comprises N consecutive command values that are the same, wherein N is a positive predetermined integer greater than or equal to 2.

6. The method of claim 1, wherein driving the pixel circuit according to the filtered command signal comprises:

setting at least one of a bandwidth, a current value and a driving frequency of the pixel circuit according to the filtered command signal.

7. A device applicable to a display driver, comprising:

a sampling circuit configured to sample a command signal by recording a plurality of command values of the command signal at different times, wherein the plurality of command values corresponds to at least one data line of a pixel circuit; and a logic circuit electrically coupled to the sampling circuit, and configured to receive the plurality of command values, wherein the logic circuit is further configured to determine a most-probably correct command value according to the plurality of command values to generate a filtered command signal indicating the determined most-probably correct command value, and is configured to provide the filtered command signal to drive the pixel circuit;

wherein the most-probably correct command value is determined to be a most representative command value among the plurality of command values.

8. The device of claim 7, wherein the logic circuit is configured to set a majority of the plurality of command values to the most-probably command value of the filtered command signal.

9. The device of claim 7, wherein the logic circuit is further configured to record the plurality of command values at a plurality of time points by a plurality of terminals, respectively; the logic circuit comprises:

a plurality of logic gates, each electrically coupled to a subset of the terminals to receive a subset of the command values, respectively.

10. The device of claim 7, wherein the logic circuit is configured to determine whether the plurality of command values comprise N consecutive command values that are the same, wherein N is a positive predetermined integer greater than or equal to 2, and the logic circuit is further configured to set the N consecutive command values to a most-probably command value of the filtered command signal.

11. The device of claim 10, wherein the logic circuit comprises a counter configured to count and generate the N consecutive command values.

12. The device of claim 10, wherein the logic circuit comprises:

a plurality of logic gates, electrically coupled to an output terminal of the sampling circuit, and configured to perform a logic operation of a present command value of the plurality of command values and a next command value of the plurality of command values; and a plurality of multiplexers, electrically coupled to a plurality of output terminals of the logic gates and an output terminal of the logic circuit.

13. The device of claim 12, wherein the logic circuit further comprises an output register, and the output register is electrically coupled between an input terminal of one of multiplexers and an output terminal of another one of the multiplexers to form a feedback path.

14. The device of claim 10, wherein the logic circuit comprises:

a counter circuit configured to record the plurality of command values of the command signal, and configured to output a counter signal; and a multiplexer configured to receive the plurality of command values of the command signal and a feedback signal from an output terminal of the device, wherein the multiplexer is configured to selectively output the received command signal or the feedback signal according to the counter signal.

15. The device of claim 14, wherein the sampling circuit comprises a plurality of registers electrically coupled in cascade, and the logic circuit further comprises:

a Iodic gate electrically coupled to an output terminal of a first register of the registers and an output terminal of a second register of the registers, and an output terminal of the logic gate electrically coupled to an input terminal of the counter circuit.

16. The device of claim 7, further comprising:

an output register electrically coupled to an output terminal of the logic circuit.

17. The device of claim 7, wherein the sampling circuit comprises a plurality of registers electrically coupled in cascade, and a present register of the plurality of registers is configured to receive the command signal and configured to transmit the command signal to a next register of the plurality of registers.

18. The device of claim 17, wherein each of the plurality of registers comprises a D-type Flip Flop.

19. A display driver, comprising:

a converter circuit configured to receive at least one original signal, and configured to acquire a command signal from the at least one original signal;

a signal filtering device electrically coupled to the converter circuit, wherein the signal filtering device is configured to record a plurality of command values of the command signal at different times, the plurality of command values corresponds to at least one data line of a pixel circuit, and the signal filtering device is further configured to determine a most-probably correct command value according to the plurality of command values to generate a filtered command signal indicating the determined most-probably correct command value, wherein the most-probably correct command value is determined to be a most representative command value among the plurality of command values; and a driving circuit electrically coupled to the signal filtering device to receive the filtered command signal, wherein the driving circuit is configured to drive the pixel circuit according to the filtered command signal.

20. The display driver of claim 19, wherein the most representative command value among the plurality of command values is defined as a most repetitive command value among the plurality of command values.

21. The display driver of claim 20, wherein the most repetitive command value is the command value of a majority of the plurality of command values.

22. The display driver of claim 19, wherein the most representative command value among the plurality of command values is defined as a most repetitive and consecutive command value among the plurality of command values.

23. The display driver of claim 22, wherein the most repetitive and consecutive command value comprises N consecutive command values that are the same, wherein N is a positive predetermined integer greater than or equal to 2.

* * * * *